United States Patent [19]

Rice

[11] Patent Number: 4,503,936

[45] Date of Patent: Mar. 12, 1985

[54] HYDRAULIC HOSE MOUNTING ARRANGEMENT FOR HIGH-VISIBILITY MAST ASSEMBLY

[75] Inventor: Bradley A. Rice, Salem, Oreg.

[73] Assignee: Towmotor Corporation, Mentor, Ohio

[21] Appl. No.: 432,584

[22] Filed: Oct. 4, 1982

[51] Int. Cl.[3] ..... B66B 9/20

[52] U.S. Cl. ..... 187/9 R; 414/631

[58] Field of Search ..... 187/9 E, 9 R, 1 R; 414/785, 628, 629, 630, 631, 618, 657, 592; 137/355.16, 355.17

[56] References Cited

U.S. PATENT DOCUMENTS

| | | | |
|---|---|---|---|
| 2,724,520 | 11/1955 | Overbeck | 187/9 E |
| 2,791,293 | 5/1957 | Schenkelberger | 187/9 E |
| 3,166,208 | 1/1965 | Quayle | 414/631 |
| 3,208,556 | 9/1965 | Shaffer | 187/9 E |
| 3,289,869 | 12/1966 | Hoyt | 214/670 |
| 3,339,768 | 9/1967 | Dixon | 214/730 |
| 3,462,028 | 8/1969 | Pi | 214/95 |
| 3,777,853 | 12/1973 | Miller | 187/9 |
| 3,968,859 | 7/1976 | Ehrhardt | 187/9 E |

OTHER PUBLICATIONS

"Attachment Hydraulics" (5 pp. no publication date).

*Primary Examiner*—Joseph J. Rolla
*Assistant Examiner*—Kenneth Noland
*Attorney, Agent, or Firm*—Phillips, Moore, Lempio & Finley

[57] ABSTRACT

Special attachments mounted on a carriage assembly of a lift truck normally require one or more hydraulic cylinders to effect the various work tasks. A plurality of flexible hoses are normally routed over a mast assembly of the lift truck and are suitably connected to the cylinders to communicate pressurized hydraulic fluid. Such routing arrangements normally impair the forward visibility of the operator and do not always provide for a compact and protected disposition of the hoses on the mast assembly. The routing arrangement (24) of this invention includes a plurality of sheaves (28) and brackets (33) for mounting and guiding loop portions (25) of flexible hoses (21) on a movable upright assembly (14) in vertically spaced and closely compacted relationship to permit vertical movements of the movable upright assembly (14) relative to the hoses (21). The hoses (21) are attached between a fixed upright assembly (12) of a mast assembly (11) and a carriage assembly (18), slidably mounted on the movable upright assembly (14).

15 Claims, 9 Drawing Figures

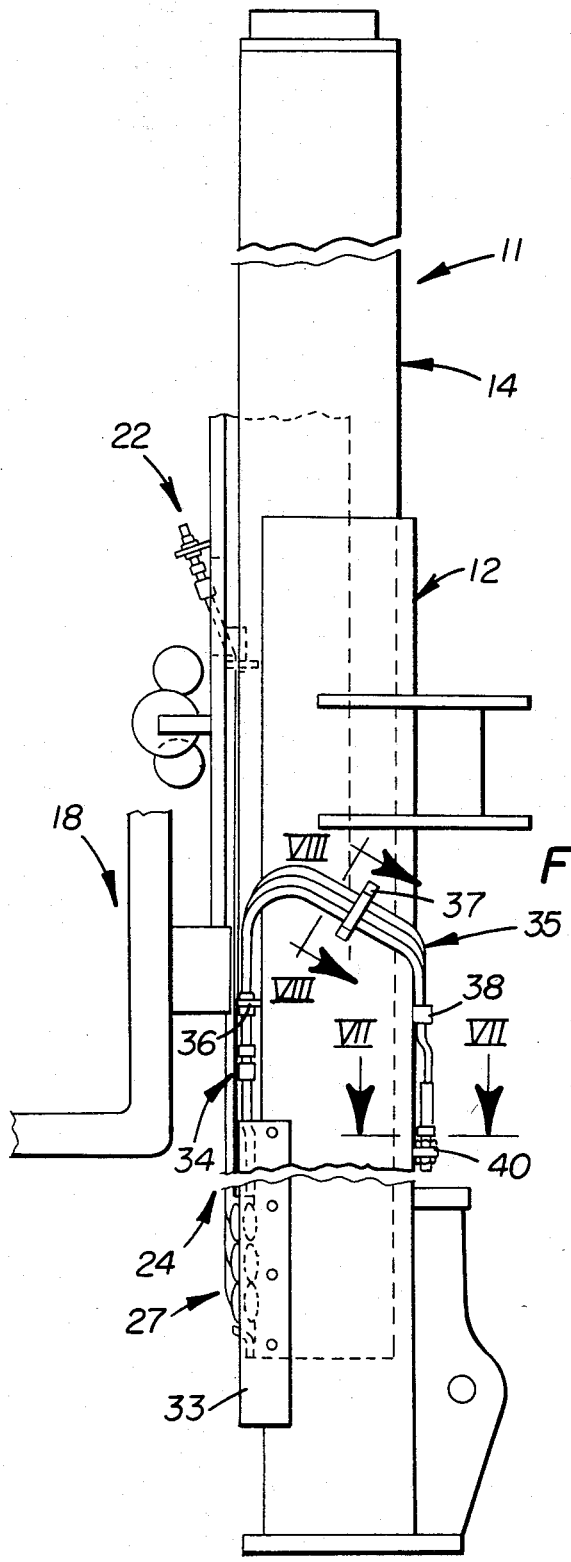
FIGURE 6
FIGURE 8
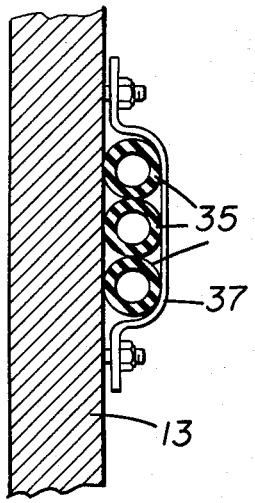
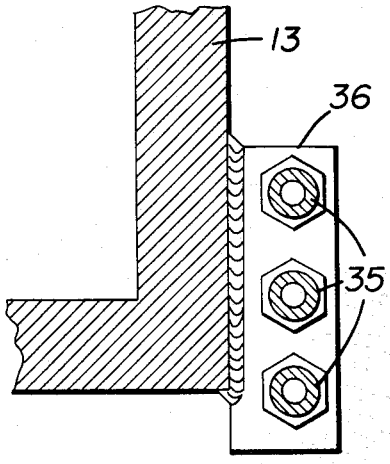
FIGURE 7

HYDRAULIC HOSE MOUNTING ARRANGEMENT FOR HIGH-VISIBILITY MAST ASSEMBLY

TECHNICAL FIELD

This invention relates generally to a mast assembly for a lift truck and more particularly to a mounting arrangement for hydraulic hoses employed on a mast assembly to provide it with a high degree of operator visibility.

BACKGROUND ART

Special attachments or work tools for lift trucks are generally attached on a carriage assembly thereof. The carriage assembly is slidably mounted on a movable upright assembly which is, in turn, slidably mounted on a fixed upright assembly. The special attachments may take the form of a rotating carriage, a load push-pull, or a carton, bale, paper roll, barrel, or general purpose clamp.

The special attachment generally includes a plurality of hydraulic cylinders adapted to be selectively actuated under control of an operator. It is highly desirable to provide a routing arrangement for the hydraulic hoses, interconnected between the cylinders and the operator control station, that affords the operator with a maximum degree of forward visibility. Conventional routing arrangements normally include a plurality of sheaves and brackets for mounting and guiding the hoses on the mast assembly with opposite ends of the hoses being interconnected between a manifold, secured on the fixed upright assembly, and a bracket, secured on the carriage assembly. The bracket carries fittings thereon, adapted for connection to the actuating cylinders for the special attachment.

In addition to impairing the operator's forward visibility, such conventional routing arrangements do not always provide the desired compactness and ability to be readily serviced, when needed. It is further desirable that a routing arrangement of this type provide adequate protection to the hoses and permit relative movement between the upright assemblies and carriage without unduly stressing the hoses.

The present invention is directed to overcoming one or more of the problems as set forth above.

DISCLOSURE OF THE INVENTION

A mast assembly comprises a fixed upright assembly, a movable upright assembly slidably mounted on the fixed upright assembly, a carriage assembly slidably mounted on the movable upright assembly, and a plurality of flexible hoses attached between the fixed upright assembly and the carriage assembly. This invention is directed to an improved routing arrangement for the hoses wherein a loop portion of each hose is positioned adjacent to a lower end of an inner upright of the movable upright assembly and means for mounting and guiding the loop portions of the hoses on the inner upright in vertically spaced and closely compacted relationship relative to each other and for permitting movement of the movable upright assembly relative to the hoses.

In one aspect of this invention, the mounting and guiding means includes at least first and second sheaves rotatably mounted in vertically spaced relationship on the lower end of the inner upright, a first loop portion entrained under the first sheave and a second loop portion entrained under the second sheave.

In another aspect of this invention, the mounting and guiding means mounts and guides the loop portions of the hoses in vertically spaced, tandem and closely compacted relationship relative to each other on the frontal side of the lower end of the inner upright and permits movement of the movable upright assembly relative to the hoses.

In still another aspect of this invention, the mast assembly is mounted forwardly on a lift truck.

The improved routing arrangement of this invention provides the operator of a lift truck or other type of industrial vehicle with a high degree of forward visibility through the mast assembly. In addition, the routing arrangement is compact, protects the hoses against damage, and permits relative movement between the upright assemblies and carriage without unduly stressing the hoses.

BRIEF DESCRIPTION OF THE DRAWINGS

Other objects and advantages of this invention will become apparent from the following description and accompanying drawings wherein:

FIG. 6 is a side elevational view of the mast assembly and routing arrangement;

FIGS. 7 and 8 are enlarged sectional views, taken in the direction of arrows VII—VII and VIII—VIII, respectively, in FIG. 6.

BEST MODE OF CARRYING OUT THE INVENTION

Figure 1:
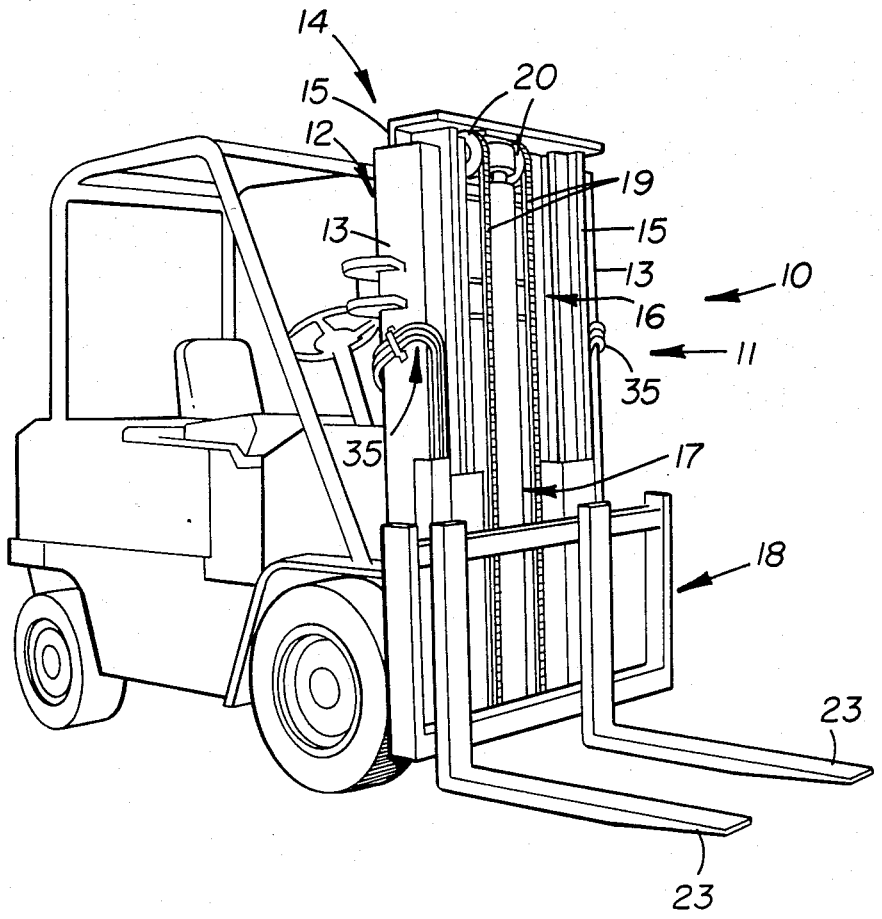
FIG. 1 illustrates a lift truck having a mast assembly employing a hose routing arrangement of the present invention thereon.

FIG. 1 illustrates a lift truck 10 having a mast assembly 11 mounted forwardly thereon in a conventional manner. The mast assembly includes an outer or fixed upright assembly 12, suitably mounted on a frame of the lift truck and having a pair of laterally-spaced uprights 13 secured together by transverse tie bars. An inner or movable upright assembly 14, including a pair of laterally-spaced uprights 15, is slidably mounted on the fixed upright assembly to be selectively raised and lowered thereon by a lift system 16 including a lift cylinder 17 attached between the fixed and movable upright assemblies.

A carriage assembly 18 is slidably mounted on the movable upright assembly and is adapted to be selectively moved thereon by chains 19, attached between the fixed upright and carriage assemblies and entrained over sheaves 20 mounted on the movable upright assembly. A plurality of flexible hoses 21 are attached between fixed upright assembly 12 and the carriage assembly and terminate at snubbed-off fittings 22 (FIG.

2), adapted for connection to standard hydraulic cylinders utilized to selectively actuate a special attachment mounted on the carriage assembly. In particular, such a special attachment (not shown) can be substituted in lieu of standard forks 23 and may take the form of a rotating carriage, a load push-pull, or a carton, bale, paper roll, barrel, or general purpose clamp. Since these types of special attachments and their actuating cylinders are well known in the art, a further description thereof is unnecessary for a clear understanding of this invention.

This invention is directed to a routing arrangement 24 adapted to compactly mount hoses 21 on the mast assembly to provide the operator of the lift truck with a high degree of forward visibility through the mast assembly. As shown in FIGS. 2, 4–6, and 9, the flexible hoses define a single loop portion 25 positioned adjacent to a lower end 26 of a respective upright 15 of the movable upright assembly. Since routing arrangement 24 is duplicated on each side of the mast assembly, only one of the routing arrangements will be described in detail with duplicate numerals depicting corresponding components and constructions of the other routing arrangement.

Figure 2:
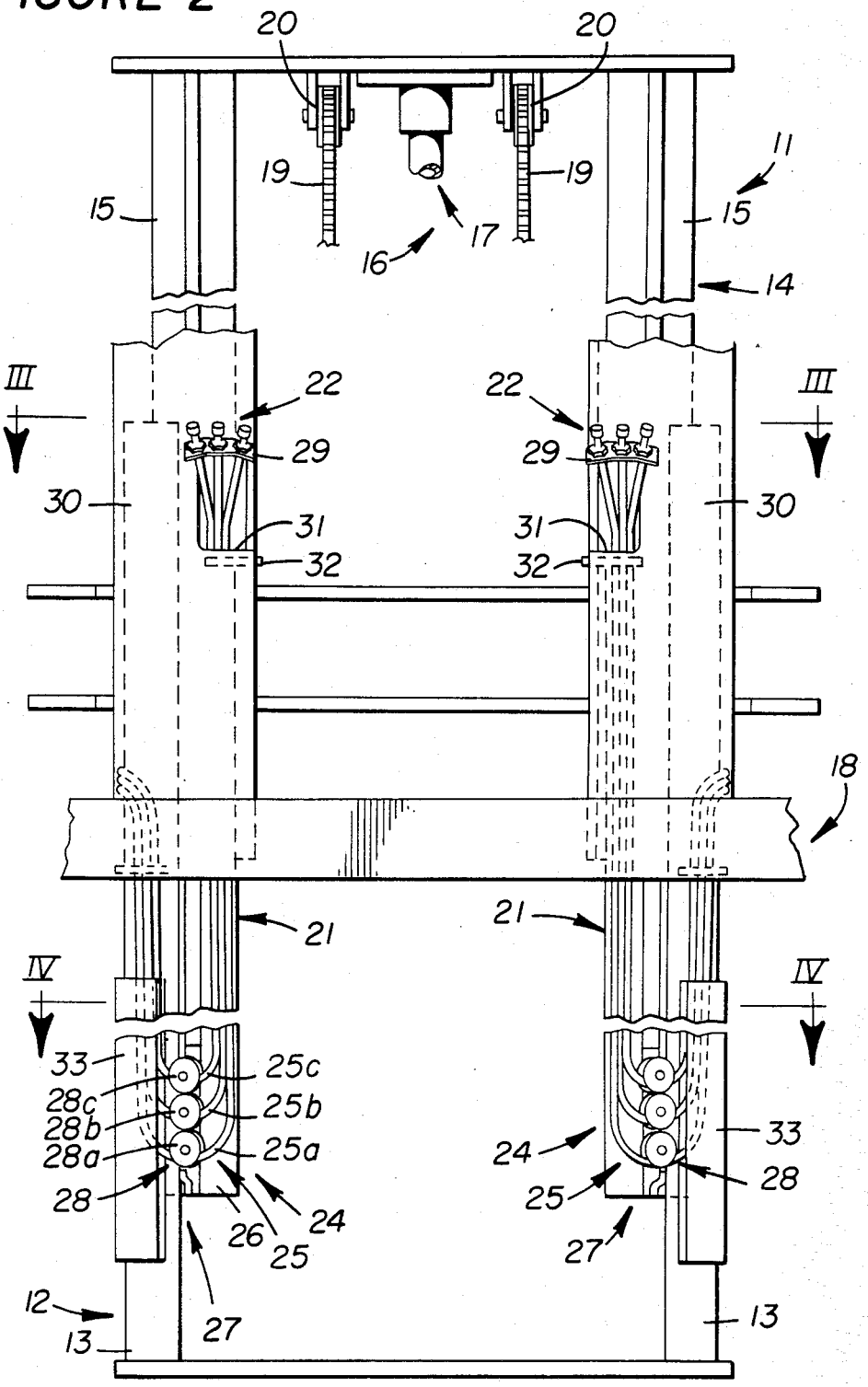
FIG. 2 is an enlarged, front elevational view of the mast assembly and routing arrangement, with portions of the mast assembly broken-away for clarification purposes.

Each routing arrangement 24 includes means 27 for mounting and guiding loop portions 25 of the flexible hoses on a respective inner upright 15 in vertically spaced, tandem and closely compacted relationship relative to each other on the frontal side of the inner upright and for permitting vertical movements of movable upright assembly 14 relative to the hoses. In the embodiment illustrated, such means 27 includes three sheaves 28 rotatably mounted in vertically spaced relationship on lower end 24 of upright 15. As shown in FIG. 2, the lowest or first loop portion **25*a* of the loop portions is entrained under a lower or first sheave 28*a* and a second loop portion 25*b* is entrained under an intermediate or second sheave 28*b* and between the first and second sheaves. The upper or third loop portion 25*c* is entrained under the upper or third sheave 28*c* and between the second and third sheaves. First and second sheaves 28*a* and 28*b* are thus mounted closely adjacent to each other and capture second loop portion 25*b* therebetween to prevent displacement of the loop portion from the sheaves. Likewise, first loop portion 25*a* is held under first sheave 28*a* whereas third loop portion 25*c* is captured between second and third sheaves 28*b* and 28*c***, respectively.

Figure 3:
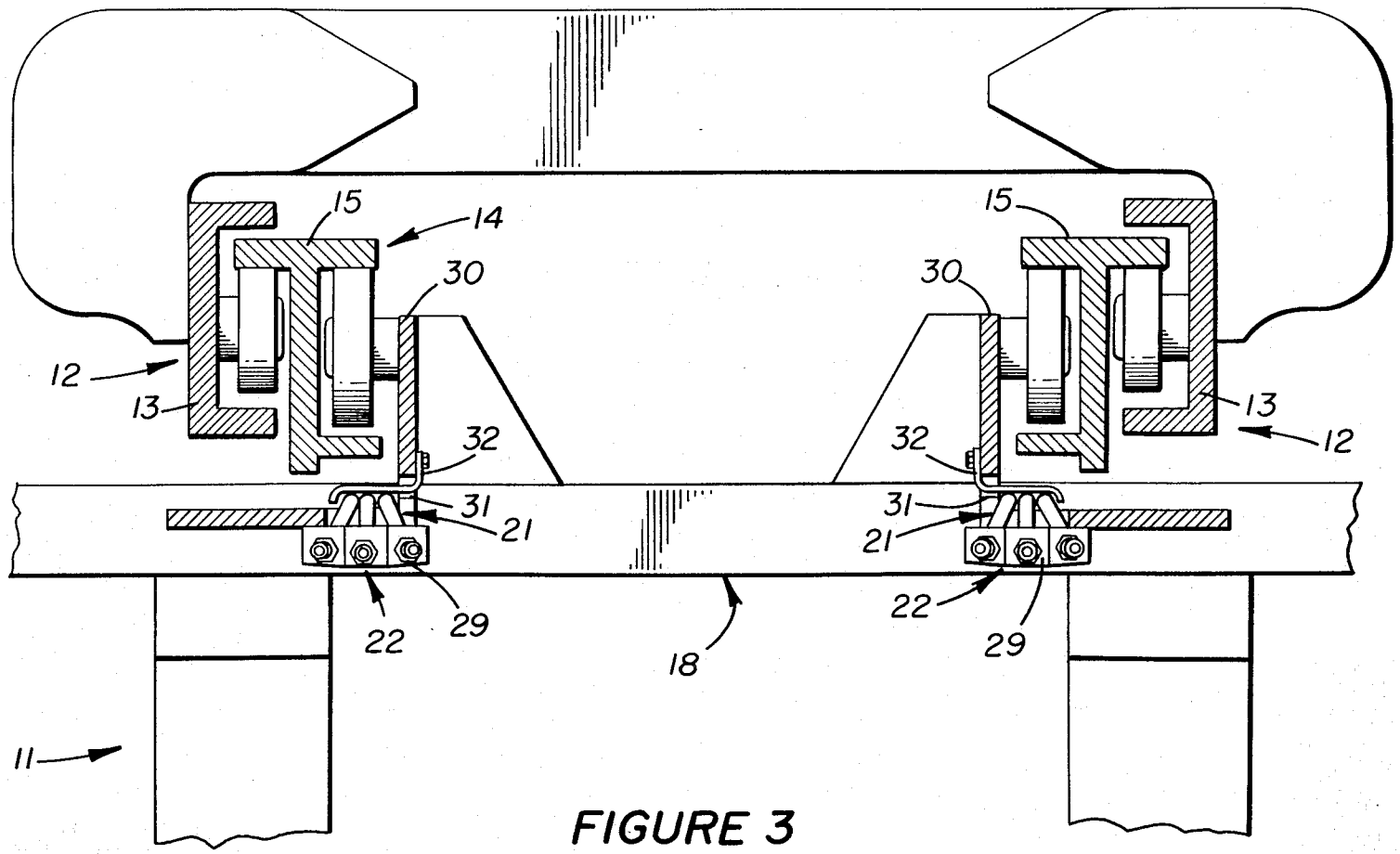
FIGS. 3 and 4 are enlarged transverse sectional views through the mast assembly, taken in the direction of arrows III—III and IV—IV, respectively, in FIG. 2.
Figure 4:
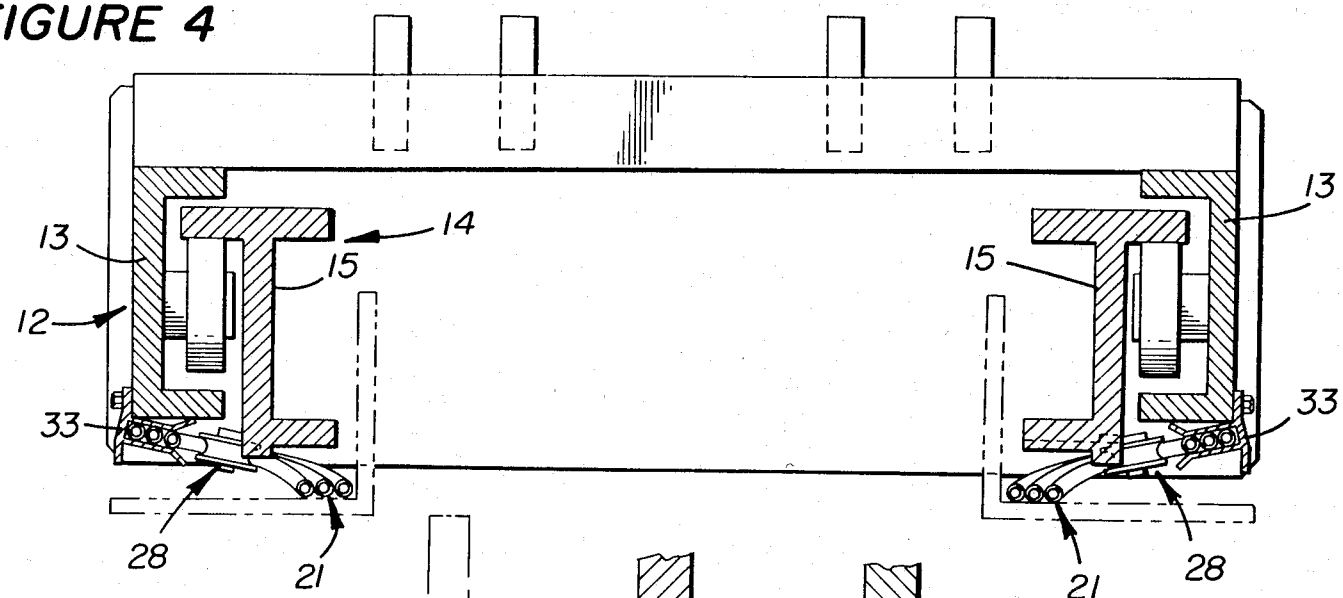

As further shown in FIGS. 2 and 3, fittings 22, adapted for attachment to the actuating cylinders of the special attachment mounted on the carriage assembly, are suitably attached on a bracket 29, secured forwardly on an upright member 30 of the carriage assembly. The hoses extend upwardly from sheaves 28 in substantial parallel relationship relative to each other and further extend through a slot 31, formed through member 30. As more clearly shown in FIG. 3, a clip 32 is attached to an inboard side of member 30, adjacent to slot 31, to retain and align upper portions of the hoses on the member.

Figure 5:
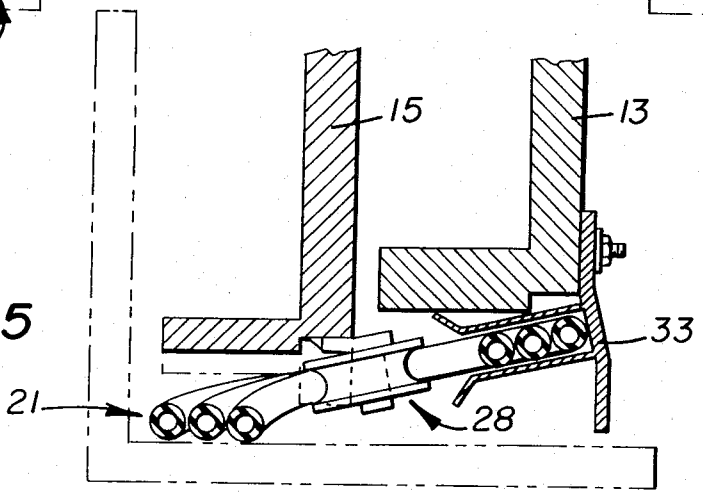
FIG. 5 is an enlarged sectional view of a portion of FIG. 4, illustrating a sheave and bracket arrangement employed in the routing arrangement.
Figure 9:
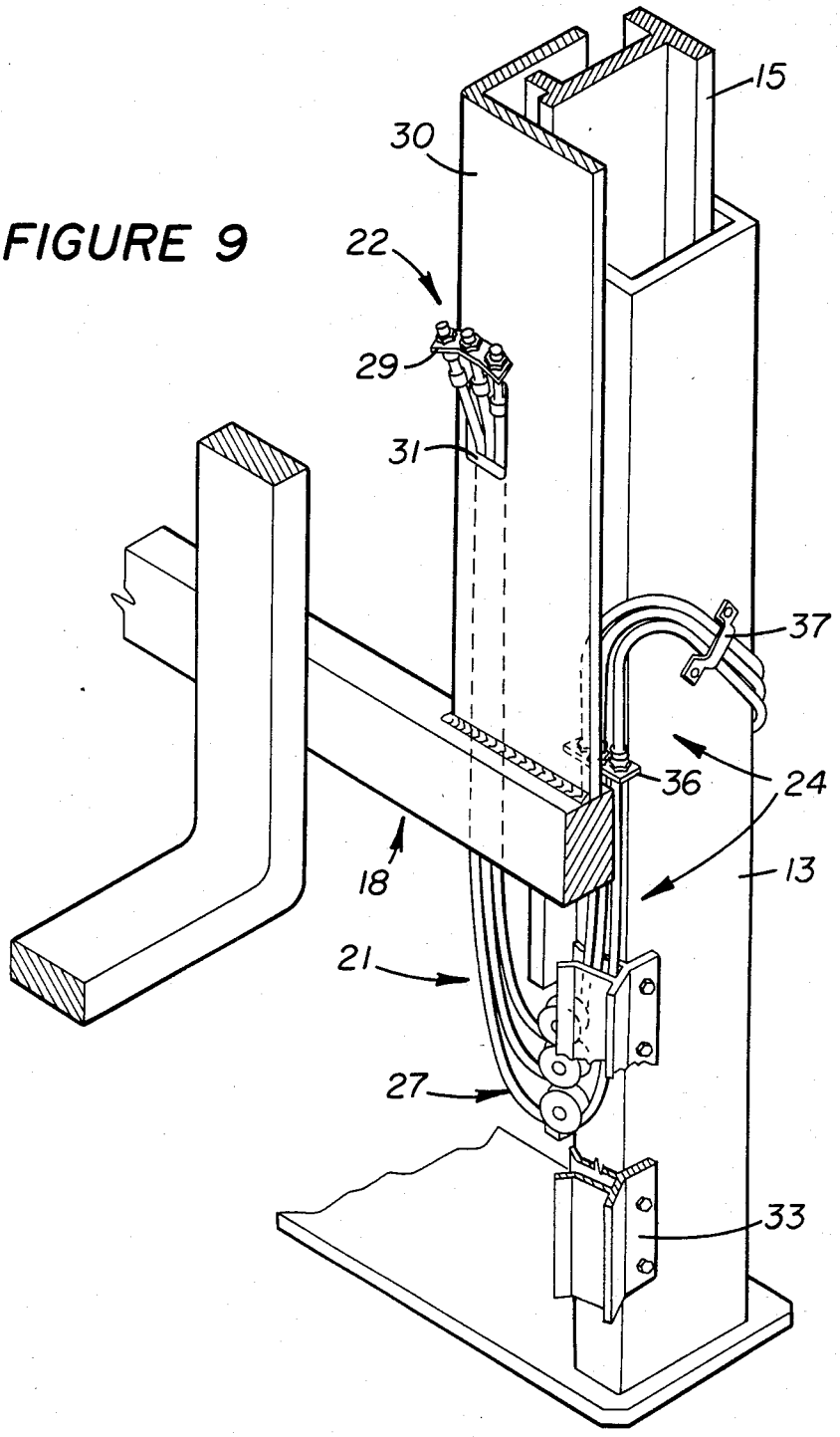
FIG. 9 is a partially sectioned isometric view of a portion of the mast assembly and the routing arrangement.

As shown in FIGS. 2, 4, 5 and 9, the hose portions on the opposite side of sheaves 28 extend upwardly in substantial parallel relationship and are captured and guided within a slotted bracket 33 having a generally U-shaped retaining portion, when viewed in cross-section, as shown in FIG. 5. The bracket is suitably secured on an inboard side of fixed upright 13 and extends inwardly to ensure that the hoses are entrapped and guided therein. As shown in FIGS. 6 and 7, the hoses are connected at suitable fittings 34 to a plurality of rigid metallic conduits 35 to communicate hydraulic fluid from the operator control system on the lift truck (not shown) to fittings 22 and thus the special attachment cylinders (not shown) adapted to be connected thereto. As shown in FIGS. 6–8, the conduits are mounted on the fixed upright assembly by brackets 36, 37 and 38 and terminate at fittings 39, also secured on the fixed upright assembly by a bracket 40.

As suggested above, fittings 39 are adapted to be connected, via flexible hoses (not shown), to an operator control system for selectively communicating hydraulic fluid to fittings 22 (FIG. 2).

INDUSTRIAL APPLICABILITY

Mast assembly 11 finds particular application to industrial trucks, such as lift truck 10 illustrated in FIG. 1. The lift truck is adapted to have lift forks 23 thereof replaced by a rotating carriage, a load push-pull, one of the various types of standard clamps, or other work tool comprising a special attachment for the lift truck. The attachment is suitably mounted on carriage assembly 18 and includes a plurality of hydraulic cylinders adapted to be connected to fittings 22 for selective actuation by the operator.

In operation, selective raising or lowering of movable upright assembly 14 on fixed upright assembly 12 by selective extension or retraction of cylinder 17 will simultaneously cause carriage assembly 18 to move on the movable upright assembly under the control of chains 19. These relative movements are accomplished without stressing flexible hoses 21 which are constructed and arranged to accommodate such movements. Routing arrangement 24 ensures that hoses 21 are compactly positioned on the mast assembly and are substantially protected against damage and wear. As shown in FIG. 2, routing arrangement 24 further ensures that the operator is accorded a high degree of forward visibility when operating the lift truck to thus ensure efficient operation of the attachment mounted on the carriage assembly.

Other aspects, objects and advantages of this invention can be obtained from a study of the drawings, the description and the appended claims.

I claim:

1. In a mast assembly (11) having a fixed upright assembly (12), including a pair of laterally spaced outer uprights (13), a movable upright assembly (14) slidably mounted on said fixed upright assembly (12) and including a pair of laterally spaced inner uprights (15), a carriage assembly (18) slidably mounted on said movable upright assembly (14), and a plurality of flexible hoses (21) attached between said fixed upright assembly (12) and said carriage assembly (18), the improvement comprising:

a routing arrangement (24) wherein said hoses (21) each define a loop portion (25) positioned adjacent to a lower end (26) of at least one inner upright (15) of said movable upright assembly (14) and means (27) for mounting and guiding the loop portions (25) of said hoses (21) on said inner upright (15) in vertically spaced and closely compacted relationship relative to each other and for permitting movement of said movable upright assembly (14) relative to said hoses (21), said means (27) including at least first (**28*a*) and second (28*b***) sheaves rotatably mounted in vertically spaced relationship on the lower end (26) of said inner upright (15), a first loop portion (25*a*) of said loop portions (25) entrained under said first sheave (28*a*) and a second loop portion (25*b*) thereof entrained under said second sheave (28*b*).

2. The mast assembly (11) of claim 1 wherein said first (28*a*) and second (28*b*) sheaves are mounted closely adjacent to each other and said second loop portion (25*b*) is captured therebetween.

3. The mast assembly (11) of claim 2 wherein said means (27) further includes a third sheave (28*c*) rotatably mounted on said inner upright (15), closely adjacent to said second sheave (28*b*), and wherein a third loop portion (25*c*) of said loop portions (25) is captured between said second (28*b*) and third (28*c*) sheaves.

4. The mast assembly (11) of claim 1 wherein said carriage assembly (18) includes a member (30) disposed forwardly thereon and further including means defining a slot (31) through said member (30) having said hoses (21) extending therethrough and a bracket (29) secured on said member (30) and mounting ends of said hoses (21) thereon.

5. The mast assembly (11) of claim 1 further including a bracket (33) secured on one of said outer uprights (13) adjacent to said means (27) and defining a generally U-shaped channel therein, said hoses (21) disposed in stacked relationship within said channel.

6. The mast assembly (11) of claim 1 further including a plurality of rigid conduits (35) each connected to a respective one of said hoses (21) and a plurality of brackets (36,38,40) attaching said conduits (35) on one of said outer uprights (13).

7. The mast assembly (11) of claim 6 wherein said conduits (35) each terminate at a fitting (40) mounted on a rearward side of said outer upright (13).

8. A lift truck (10) having a mast assembly (11) mounted forwardly thereon, said mast assembly (11) comprising:

a fixed upright assembly (12) having a pair of laterally spaced outer uprights (13), a movable upright assembly (14) slidably mounted on said fixed upright assembly (12) and having a pair of laterally spaced inner uprights (15), a carriage assembly (18) slidably mounted on said movable upright assembly (14), a plurality of flexible hoses (21) attached between said fixed upright assembly (12) and said carriage assembly (18), said hoses (21) each defining a loop portion (25) positioned adjacent to a lower end (26) of at least one of the inner uprights (15) of said movable uprights assembly (14), and means (27) for mounting and guiding the loop portions (25) of said hoses (21) on said one inner upright (15) in vertically spaced and closely compacted relationship relative to each other and for permitting movement of said movable upright assembly (14) relative to said hoses (21), said means (27) including at least first (28*a*) and second (28*b*) sheaves rotatably mounted in vertically spaced relationship on the lower end (26) of said inner upright (15), a first loop portion (25*a*) of said loop portions (25) entrained under said first sheave (28*a*) and a second loop portion (25*b*) thereof entrained under said second sheave (28*b*).

9. The lift truck (10) of claim 8 wherein said first (28*a*) and second (28*b*) sheaves are mounted closely adjacent to each other and said second loop portion (25*b*) is captured therebetween.

10. The lift truck (10) of claim 9 wherein said means (27) further includes a third sheave (28*c*) rotatably mounted on said inner upright (15), closely adjacent to said second sheave (28*b*), and wherein a third loop portion (25*c*) of said loop portions (25) is captured between said second (28*b*) and third (28*c*) sheaves.

11. The lift truck (10) of claim 8 wherein said carriage assembly (18) includes a member (30) disposed forwardly thereon and further including means defining a slot (31) through said member (30) having said hoses (21) extending therethrough and a bracket (29) secured on said member (30) and mounting ends of said hoses (21) thereon.

12. The lift truck (10) of claim 8 further including a bracket (33) secured on one of said outer uprights (13) adjacent to said means (27) and defining a generally U-shaped channel therein, said hoses (21) disposed in stacked relationship within said channel.

13. The lift truck (10) of claim 8 further including a plurality of rigid conduits (35) each connected to a respective one of said hoses (21) and a plurality of brackets (36,38,40) attaching said conduits (35) on one of said outer uprights (13).

14. The lift truck (10) of claim 13 wherein said conduits (35) each terminates at a fitting (40) mounted on a rearward side of said outer uprights (13).

15. The lift truck (10) of claim 8 wherein a plurality of said hoses (21) are mounted on each of said inner uprights (15) by said means (27).

* * * * *